US006681502B1

(12) United States Patent
Birkenstock

(10) Patent No.: US 6,681,502 B1
(45) Date of Patent: Jan. 27, 2004

(54) SANDAL

(76) Inventor: Christian Birkenstock, Bergstrasse 41, 53545 Ockenfels (DE)

( * ) Notice: Subject to any disclaimer, the term of this patent is extended or adjusted under 35 U.S.C. 154(b) by 0 days.

(21) Appl. No.: 09/662,464

(22) Filed: Sep. 15, 2000

Related U.S. Application Data

(63) Continuation-in-part of application No. PCT/DE99/00658, filed on Mar. 8, 1999.

(30) Foreign Application Priority Data

Mar. 19, 1998 (DE) ..... 298 04 991 U

(51) Int. Cl.[7] ..... A43B 3/12; A43B 3/10; A43C 13/00

(52) U.S. Cl. ..... 36/11.5; 36/15; 36/7.5; 36/30 R

(58) Field of Search ..... 36/11.5, 88, 91, 36/92, 94, 7.5, 25 R, 28, 30 R, 45, 14, 19.5, 22 A, 12, 17 R, 22 R, 100, 101, 15

(56) References Cited

U.S. PATENT DOCUMENTS

| | | | | | |
|---|---|---|---|---|---|
| 3,468,040 | A | * | 9/1969 | Fukuoka | 36/11.5 |
| 4,571,851 | A | | 2/1986 | Yamada | |
| 4,651,443 | A | * | 3/1987 | Eckstrom | 36/17 R |
| 4,685,223 | A | * | 8/1987 | Long | 36/12 |
| 4,947,560 | A | * | 8/1990 | Fuerst et al. | 36/91 |
| 5,092,060 | A | * | 3/1992 | Frachey et al. | 36/28 |
| 5,741,568 | A | * | 4/1998 | Rudy | 36/28 |
| 5,896,677 | A | * | 4/1999 | Barsorian | 36/11.5 |
| 6,023,857 | A | * | 2/2000 | Vizy et al. | 36/28 |
| 6,115,940 | A | * | 9/2000 | Chen | 36/14 |

FOREIGN PATENT DOCUMENTS

| | | | | |
|---|---|---|---|---|
| DE | 30 43 725 | | 6/1982 | |
| DE | 3722158 | * | 1/1989 | 36/11.5 |
| EP | 0080783 | * | 6/1983 | 36/11.5 |
| FR | 2750831 | | 1/1998 | |
| GB | 2034168 | | 6/1980 | |

* cited by examiner

*Primary Examiner*—Anthony D. Stashick
(74) *Attorney, Agent, or Firm*—Connolly Bove Lodge & Hutz LLP

(57) ABSTRACT

A sandal with a shoe bottom with raised sole rims on either side of the shoe bottom, a foot support bed incorporated in the shoe bottom, an upper strapping material, and a cover sole connected to the shoe bottom and having raised edge regions aligned with and extending past the raised sole rims on either side of the shoe bottom. The raised edge regions each form a lateral fastening portion for attachment to the upper strapping material.

25 Claims, 6 Drawing Sheets

SANDAL

RELATED APPLICATIONS

This application is a continuation-in-part of, and claims priority from, International Application PCT/DE99/00658, filed Mar. 8, 1999, which designated the United States, the entire contents of which are incorporated herein by reference.

TECHNICAL FIELD

The invention relates to a sandal with a shoe bottom which forms in particular a midsole and to which a strapping is fastened via an insole which is connected to the shoe bottom on the inside, and with an outer sole rim which is located at the strapping at least on the right and the left at the side and between which a foot support bed is arranged. The invention also relates to such a shoe bottom with an insole.

STATE OF THE ART

Sandals of the above type have long been widespread and are therefore known. The connection of the strapping to the shoe bottom is usually effected by the strapping being glued or sewn together with the shoe bottom. To this end, an angled end region of the strapping frequently extends between the shoe bottom and an outsole glued against the latter. In the case of thicker shoe bottoms, the strapping is often glued into lateral recesses of the shoe bottom. The ends of the strapping are also frequently introduced into the mold to be used during production of the shoe bottom, so that the strapping is foamed into the shoe bottom.

During walking in sandals, the foot is supported on the shoe bottom and often transmits relatively great forces into the strapping, as a result of which there is a risk of the strapping coming away from the shoe bottom. This is particularly true of inexpensive sandals, in which the strapping is not inserted under the shoe bottom but is simply glued to the shoe bottom from the side.

DE 30 43 725 U1 describes a flexible shoe in which the shoe bottom is covered on the inside by an insole which, by means of an edge region extending outward in a flange-like manner, is glued from above onto a raised sole rim. This edge region is connected to the upper of the shoe by a seam. Such a shoe, which has the visual appearance of a welted shoe, is relatively stable because the upper and the insole form a unit as a result of the seam between them. However, the requirement for an outwardly directed edge of the upper and of the insole mean this design cannot be used for sandals. Furthermore, on account of the necessary seam holes, the seam leads to a weakening of the strapping and of the edge of the insole, so that the seam holes can, in the event of great forces being applied, act like a perforation, and this may result in tearing of the strapping.

According to FIG. 2 of GB 2 034 168 A, a sandal with a shoe bottom serving as a midsole is known, on the underside of which an outsole is arranged and on the upper side of which an insole is arranged. The insole is of thicker design toward each lateral edge region and has, in the region of the strapping to be attached, one or more vertically upwardly projecting flange portion(s) in a raised sole rim. Arranged toward the outside on each of these portions is a groove.

The lower portion of the upper-material band or strapping of the sandal is inserted into the groove and, for example, sewn together with the flange portions. On account of this construction, the insole is made from a hard polyurethane material, so that the flange portions project upward rigidly.

The support bed of the sandal is moreover not formed by the midsole but by the thicker insole, so that the latter cannot be compared with thin, for example 1 mm thick, and generally soft, leather insoles which are introduced in a fixed or loose manner or are used as a covering in dish-shaped deep foot support beds for orthopedic sandals.

OBJECT AND SOLUTION

The invention is based on the problem of designing a sandal of the type referred to in the introduction in such a manner that its strapping is connected to the shoe bottom as cost-effectively and yet at the same time as reliably as possible.

In addition, the object is to produce a shoe bottom of the type referred to in the introduction, on which the strapping of a sandal can be mounted in such a cost-effective and reliable manner.

According to the invention, this problem is solved in a sandal of the type referred to in the introduction by virtue of the fact that the foot support bed is incorporated in the shoe bottom and consists of a dish-shaped footbed, with an upwardly extending sole rim which completely surrounds the footbed at the side, a simple thin cover sole is fastened as an insole on the shoe bottom, this insole has an edge region which, only to the right and the left at the side, projects freely upward beyond the sole rim of the shoe bottom and the footbed there, these edge regions each form an outer lateral fastening portion for the strapping or also for an outer portion which protrudes from the shoe bottom and likewise serves for fastening the strapping, fastening locations in the form of gaps being provided on the outside of the shoe bottom for the ends of the strapping of the sandal, the ends of the strapping are in each case guided into these gaps of the shoe bottom, and the strapping is glued together with the fastening portions of the edge regions or with the protruding portions.

Such a sandal appears very light because the shoe bottom does not have to project significantly outward beyond the location of the connection to the strapping. As the strapping is glued from the outside against the edge region of the insole, it is possible, by dimensioning the edge region sufficiently, to produce a large gluing surface suitable for the transmission of great forces, without in this way imparting a heavy appearance to the sandal. Furthermore, the gluing is stressed only by shearing forces, which in turn is advantageous in terms of its durability. As no seam is necessary for connecting the upper to the insole, no weakening is caused by seam holes.

The sandal has a particularly pleasing appearance as the shoe bottom designed as a dished sole with a footbed has a laterally raised sole rim around the entire circumference, and the strapping ends between this sole rim of the shoe bottom and the edge region of the insole.

In addition to the fastening portions on the projecting edge regions of the insole, fastening locations in the form of simple gaps are provided on the shoe bottom, into which the ends of the strapping can be guided in a suitable manner.

The location of the butt joint between the strapping and the shoe bottom is invisible if, according to claim 4, the sole rim overlaps the strapping with a lip on the outside of this strapping.

The invention allows various further embodiments. In particular, a portion protruding on both sides from the shoe bottom can additionally be provided, which portion reinforces the outer sides of the projecting edge regions of the insole, which sides serve as fastening portions.

According to a preferred embodiment, provision is alternatively made, according to claim 2, that the strapping of the upper-material band of the sandal is not glued directly against an edge region of the insole, which projects upwardly beyond the edge of the shoe bottom, but that a stabilizing layer extends laterally from the shoe bottom, which likewise has a portion which projects upwardly beyond the edge of the shoe bottom and on the outside of which that end of the strapping on the shoe-bottom side is likewise glued and on the inside of which the upwardly projecting edge region of the insole is glued.

According to claim 9, the stabilizing layer can consist of a woven fabric which is anchored in the shoe bottom.

In this way, a particularly stable connection of the strapping to the shoe bottom can be achieved, and the lateral upper-material band of the strapping can end essentially at the outer upper edge of the shoe bottom designed as a dished sole with a footbed.

In a shoe bottom designed according to claim 1 with a dish-shaped footbed, a foot-contoured curved shape of the footbed modeled on the anatomy of the foot and a corresponding shape, visible from the outside, of the upper edge of the dished sole can be designed.

According to claims 3 and 5, an outwardly opening recess is provided on the upper edge along the upper sole rim of the shoe bottom, in which recess the outer edge of that end of the upper-material band of the sandal strapping on the shoe-bottom side comes to lie.

In this respect, on account of the arrangement of the sandal strapping, outer covering of the transition from the stabilizing layer, which consists, for example, of a piece of woven fabric, or from the lateral edge regions of the insole to the shoe bottom is afforded over a considerable length of the continuously extending part of the upper-material band.

This recess is designed with the same height over its entire length and in a manner corresponding to the curved shape of the upper edge of the shoe bottom which is designed in the form of a dished sole with a footbed.

The lateral upper-material band is arranged so as to form a butt joint there and consequently ends with a correspondingly curved shape of the outer edge.

According to claim 6, the thickness of the material of the strapping tapers toward that end on the shoe-bottom side in such a manner that a constant continuous transition in the material thickness is afforded, in particular in the region of the portions of the stabilizing layer which are glued on laterally there and of the edge region of the insole, which projects upward there.

In this respect, when the sandal is worn, there are no irritating, noticeable transition points at the fastening of the strapping.

According to claim 7, the opposite end faces of the strapping and of the sole rim are the same thickness and are designed to form a butt joint, their outer sides being in alignment, as a result of which there is a constant transition here also.

According to claims 8–12, an advantageous design and arrangement of the stabilizing layer is afforded, in particular in relation to the shoe bottom.

Furthermore, suitable dimensioning of the edge regions of the insole and of the freely outwardly projecting lateral portions of the stabilizing layer or of the woven fabric support forming it is achieved.

The underside of the shoe bottom designed as a dished sole with a footbed can itself form the outsole of the sandal, in which case an abrasion-resistant, for example compressed, material region must be provided.

However, the outsole can also be glued on as a separate molding in a manner known per se, the shoe bottom constituting only a midsole in this case. This then consists of, for example, an EVA mixture which is free of CFCs and solvents. Underneath the insole, which, according to claim 13, preferably consists of leather, other usual covering materials for foot support beds can also be provided, such as a fine and coarse jute woven fabric.

According to claim 16, the invention also relates to a shoe bottom, in particular for use in a sandal according to claims 1–15, which shoe bottom can be designed as a midsole and is then, according to claim 29, additionally to be provided with an outsole.

The shoe bottom and the insole arranged thereon on the inside have an outer raised sole rim with a foot support bed formed in between on the upper side, the foot support bed being incorporated in the shoe bottom and consisting of a dish-shaped footbed, with an upwardly extending sole rim which surrounds the footbed completely at the side, a simple cover sole being fastened as an insole on the shoe bottom, this insole having an edge region which, only to the right and to the left at the side, projects freely upward beyond the sole rim of the shoe bottom and the footbed there, these edge regions each forming an outer lateral fastening portion for the strapping or also for an outer portion which protrudes from the shoe bottom and likewise serves for fastening the strapping, and fastening locations in the form of gaps being provided on the outside of the shoe bottom for the ends of the strapping of the sandal.

The further claims 17–28 relate to advantageous embodiments of this shoe bottom, essentially the advantages referred to in the introduction being achieved.

DESCRIPTION OF THE DRAWING

In particular for further explanation of the basic principle of the invention, a first embodiment of a sandal and a further preferred embodiment are illustrated in the drawing, in which:

FIG. 1 shows a shoe bottom (1) with a circumferential, external, upwardly raised sole rim (2). This sole rim (2) has on the outside, at least in the region of a strapping (3), a lip (6) which bears against this strapping (3) from the outside.

Figure 1:
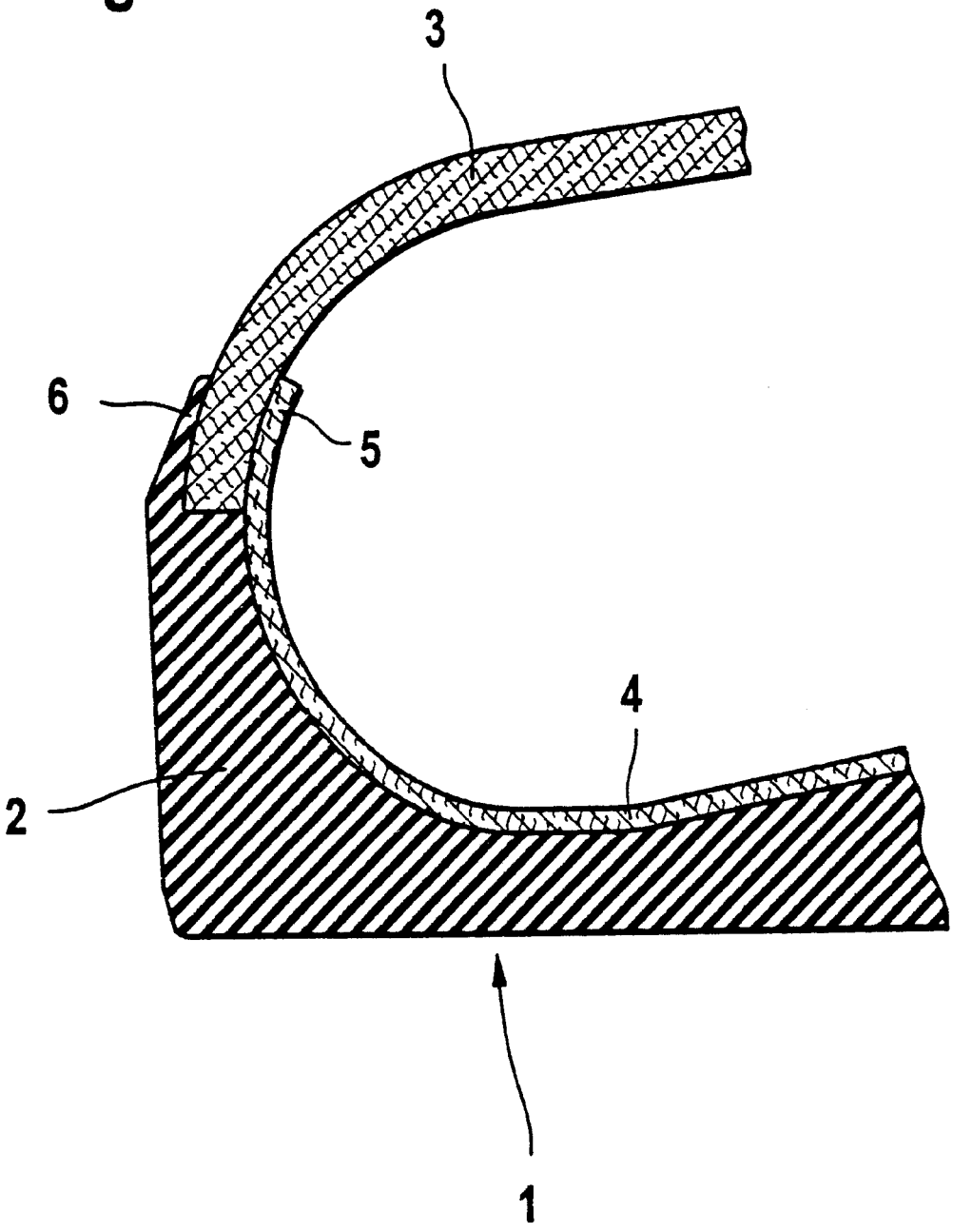
FIG. 1 shows a cross section through the edge region of a first sandal, in particular its shoe bottom, the strapping and the internal insole of the sandal, which insole projects with an outer edge region at each side, only a left outer region being illustrated.

An insole (4) is glued onto the shoe bottom (1) from above and has an upwardly directed edge region (5). That end of the strapping (3) on the shoe-bottom side is glued against this edge region (5) from the outside. The location of the butt joint between the lower end of the strapping (3) and the shoe bottom (1) is covered by the upwardly projecting lip (6).

Figure 2:
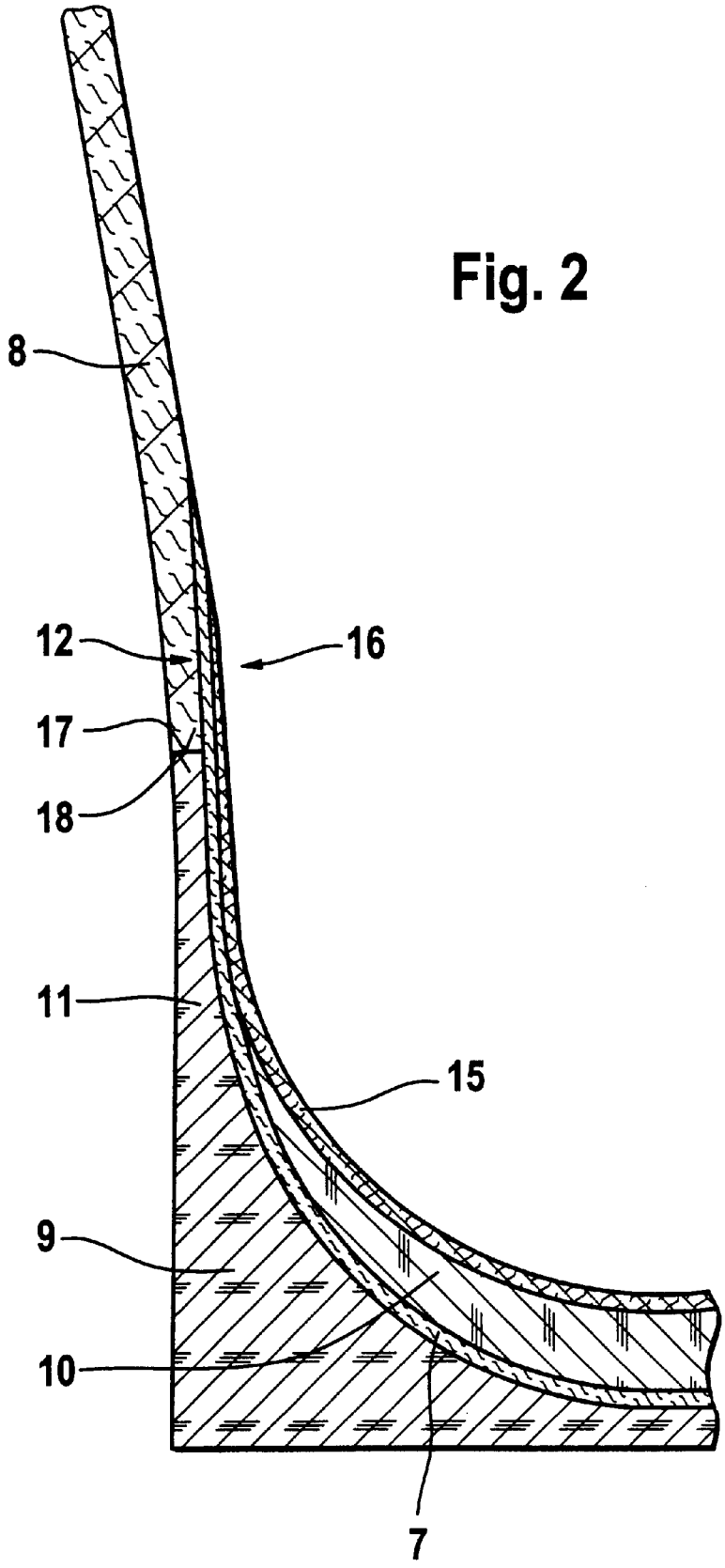
FIG. 2 shows a preferred, modified embodiment of the sandal, the edge region being illustrated in cross section.
Figure 3:
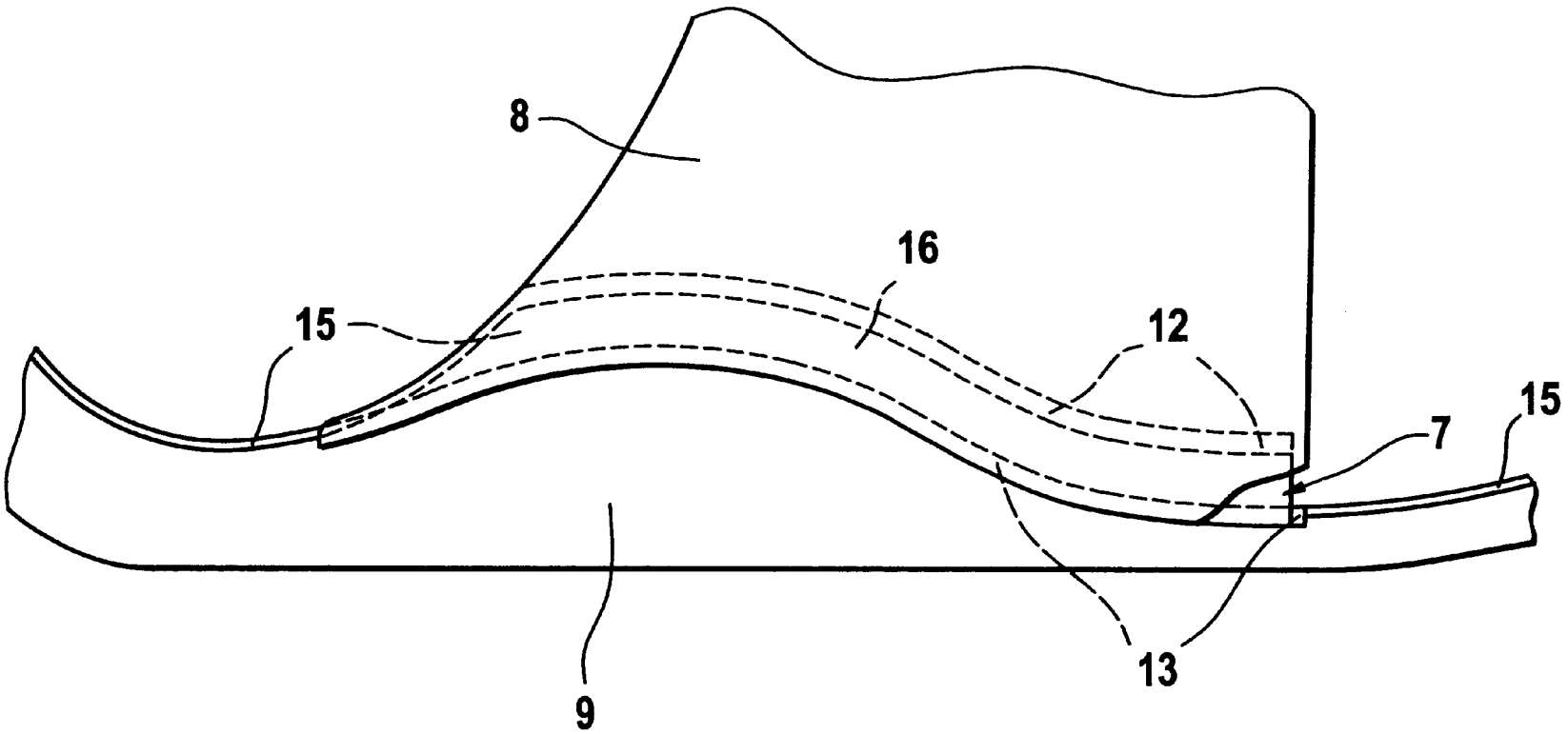
FIG. 3 shows a side view of the sandal according to FIG. 2, the shoe bottom of which is designed as a curved dished sole with a footbed and, despite the arrangement of a strapping in the form of a wide upper-material band, is visible over the entire length on the outside at the side.
Figure 4:
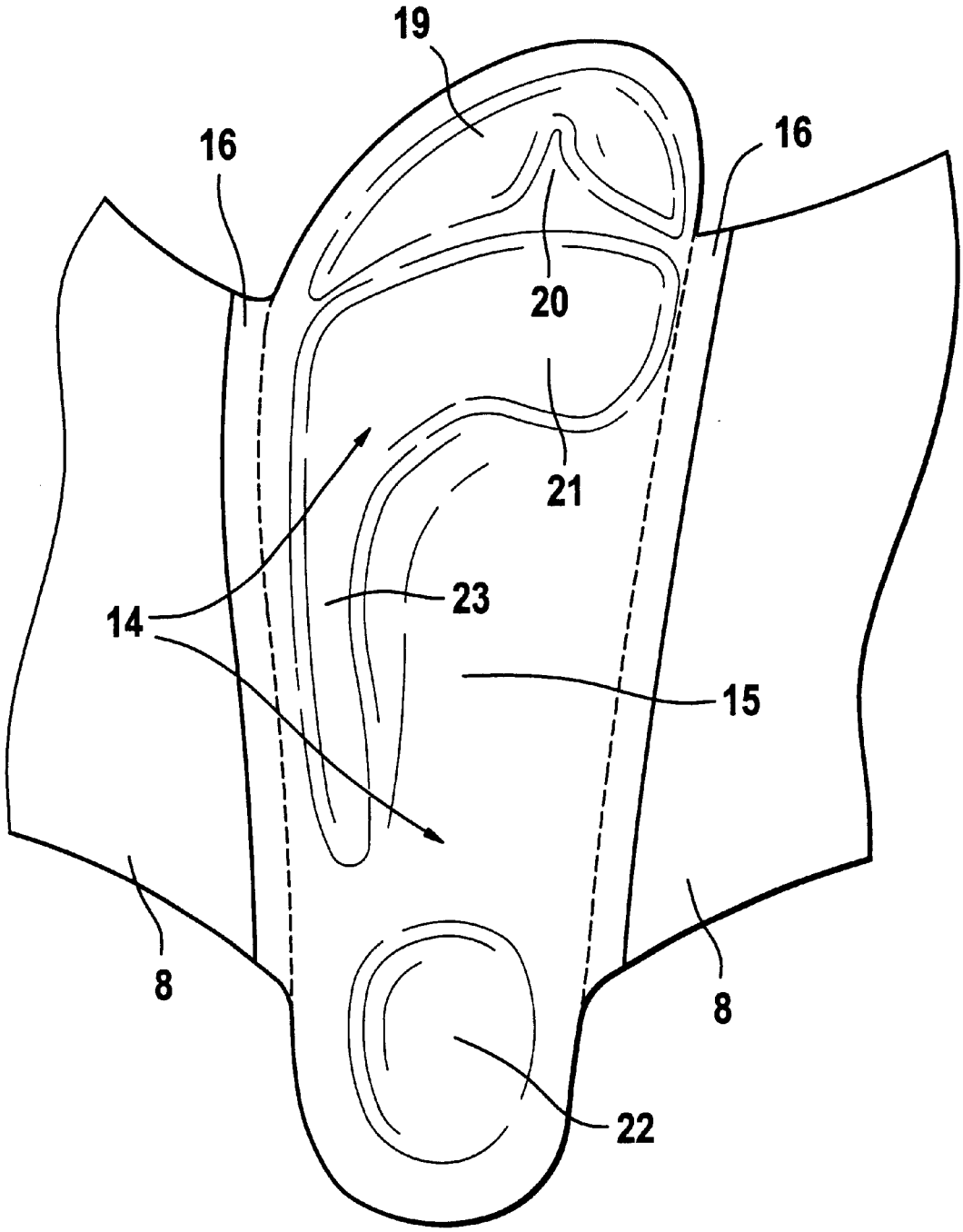
FIG. 4 shows a top view of the sandal according to FIGS. 2 and 3 illustrating the footbed of the dished shape with lateral outer portions of the upper-material band and with outer edge regions of the insole overlapping these portions in each case toward that end on the shoe-bottom side, on the underside of which regions a stabilizing woven fabric layer is situated.

FIGS. 2, 3 and 4 show a modified preferred embodiment of a sandal, the shoe bottom (9, 10) of which is designed as a dished sole with a footbed (14), which sole is completely visible outwardly over the entire height, the footbed being modeled in a foot-contoured manner on the anatomy of the foot and in particular tapering toward the ball part. Outwardly, the upper edge extends in a curved shape.

As can be seen in FIG. 2, the shoe bottom (9, 10) consists of two portions (9, 10), between which a stabilizing layer (7) in the form of a woven fabric layer is embedded.

This stabilizing layer has on both sides an outer upwardly projecting portion (12) which, in relation to the raised sole rim (11) of the shoe bottom (9, 10), emerges from the latter toward the inside.

The edge region (16) of the insole (15), which projects upward beyond the edge of the shoe bottom, is glued on one side of the outer part of the portion (12), and that end of the strapping (8) on the shoe-bottom side, which strapping is formed by the upper-material band of the sandal, is glued on the other side.

The thickness of this end of the strapping toward its outer end face (18) is tapered according to the thickness of the outer portion (12) of the stabilizing layer and of the projecting edge region (16) of the insole (15).

In this respect, the location of the butt joint of the end face (18) of the strapping and the end face (17) of the raised sole rim (11) is covered from the inside, a continuous transition being afforded from the thickness of the strapping to the shoe bottom (9, 10), the width of which increases in the downward direction, or to the sole rim (11).

In this connection, the end faces (17, 18) of the strapping (8) and of the raised sole rim (11) are the same thickness and form a butt joint.

As can be seen in FIG. 3, additional retention of the strapping (8) is afforded by an outwardly opening longitudinal recess (13) which extends along the upper sole rim (11) of the shoe bottom (9, 10) and has a depth corresponding to the thickness of that end of the strapping (8) on the shoe-bottom side.

This recess (13) extends with the same height along the upper sole rim (11), so that both the recess (13) and that end of the strapping (8) on the shoe-bottom side extend in an outwardly visible curved shape which is modeled on the foot-contoured anatomy of the foot and corresponds to the shaping of the footbed (14) of the dished sole (9, 10).

The dished sole can be molded in one piece from a polyurethane material, the stabilizing layer (7) being located and foamed therein during production of the shoe bottom in the compression mold.

However, instead of a polyurethane material, a cork/latex composite material with a high cork content can be used to make the shoe bottom, so that the foot-shaped sole is lightweight and flexible.

The insole (15) is likewise glued onto the shoe bottom (9, 10) or its footbed (14), the upwardly directed edge regions (16) of the insole (15) also being glued against the outer portions (12) of the stabilizing layer (7) which consists of a woven fabric.

In this respect, the outer edge regions (16) of the insole (15), which is usually made of leather and with a thickness of 0.7–1 mm, are stabilized by the stabilizing layer (7); this affords, in particular, a reinforcement of the connection between the raised sole rims (11) of the shoe bottom (9, 10), which are glued onto the stabilizing layer from the outside, and that end of the strapping (8) on the shoe-bottom side, which is attached or inserted there.

In FIG. 4, the shoe bottom (9, 10) of dish-shaped design and the outer anatomical footbed (14) can be seen in a top view; a recess (19) in the front part for accommodating the toes, a toe spreader (20), a transverse arch support (21) having a pad and extending upward roughly in the middle, the recess (22) for the heel, and an outer longitudinal arch support (23) can also be seen.

The insole (15) consisting of leather is glued onto the footbed, the edge regions (16), which project upward beyond the footbed at the side, extending over roughly ⅔ of the length of the footbed.

These free edge regions have a width of roughly 2.5 cm and in each case extend at the side at that end of the strapping (8) on the shoe-bottom side, which strapping forms the sandal upper-material band.

Under each of the edge regions (16) of the insole (15), the outer portion (12) of the stabilizing layer (7) extends on the right and the left at the side, which layer, in the form of a woven fabric, is embedded in the parts (9, 10) of the shoe bottom except for the portion (12) which, as illustrated in FIG. 2, extends freely outward.

In the preferred, modified embodiment of the sandal according to FIGS. 2, 3 and 4 the outer portion (12) of the stabilizing layer (7) projecting upwardly over the raised sole rim (11) of the shoe bottom (9,10) is higher than the edge region (16) of the insole (15) projecting also upward beyond the edge of the shoe bottom. These outer portions (12) are not shown in the top view of the sandal according to FIG. 4 at the inside of the lateral outer portions of the upper-material band.

Figure 5:
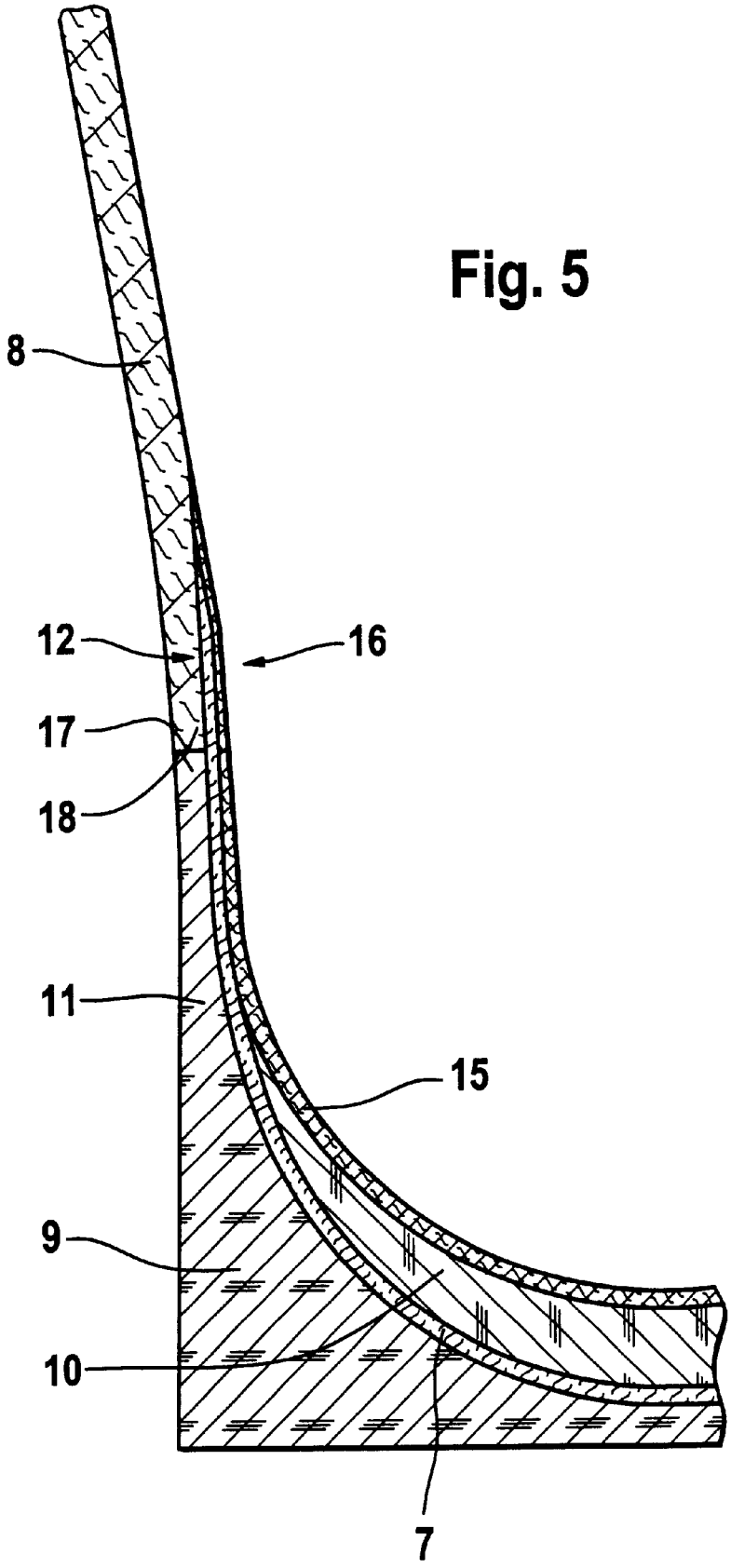
FIG. 5 shows a modification of the preferred, modified embodiment of the sandal according to FIGS. 2, 3 and 4, the edge region being illustrated in cross section like in FIG. 2.
Figure 6:
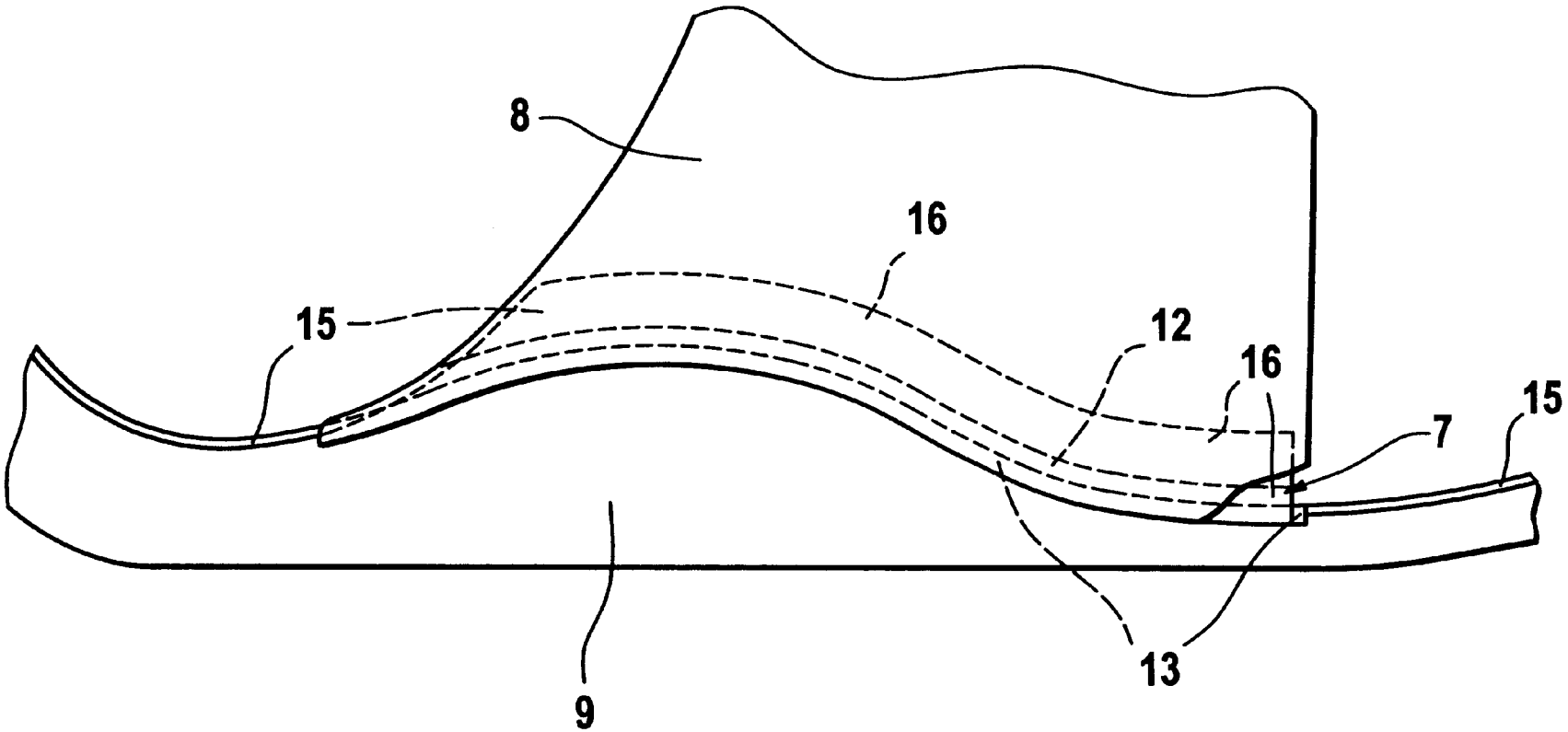
FIG. 6 shows a side view of the sandal according to FIG. 5, the shoe bottom of which is designed as a curved dished sole with a footbed and the end of the strapping on the shoe-bottom side extends again in an outwardly visible curved shape of the upper sole rim of the dished shoe bottom whereas at a large portion the shoe-bottom side is visible over the entire length and heigth.

The sandal of FIGS. 5 and 6 is only modified in respect to the sandal of FIGS. 2–4 by the used outer upwardly projecting portion of the stabilizing layer (7) which is of shorter height. The portion (12) forms only a narrow lip fixed to the inner side of the edge region (16) along the full length of the upper-material band (8). Thus the portion (12) of the sandal according to FIGS. 5 and 6 being surpassed and covered by the edge region (16) whereby this outer upwardly projecting portion of the stabilizing layer is made of smaller height.

Though principally a stabilizing layer for the edge region (16) of the insole (15) may be formed by a mere upper projection of the sole rim (11) being higher than the location of the butt joint between the lower end of the strapping (8) and the shoe bottom (9) and which becomes glued or vulcanized directly to the insole (15) made of leather and its upwardly projecting edge regions (16) there is used in the sandal according to FIGS. 5 and 6 again a separate stabilizing layer (7) in the form of a woven fabric layer embedded with one end portion between the two portions (9,10) of the shoe bottom (9,10).

Thus it is possible that forces acting in the upper-material band become only effective far away from the sole rim within the middle of the shoe bottom.

As shown in the side view of the preferred sandals of FIGS. 3 and 6 the upper-material band (8) is fixed contrary to known methods used for sandals having a dished sole with a footbed nearby along the sole rim (11) and the recess (13) such that this strapping (8) is shorter and a large part of the shoe bottom side is visible over the entire length and height.

Inspite of the much more narrower part of the upper-material band at this side of the shoe bottom compared to that of known sandals with a curved dished sole there is obtained a strong fixation of the upper-material band (8) along the insole (15) and at the stabilizing layer (7) as well as along the recess (13) of the sole rim (11) to the shoe bottom (9,10).

The insole being directly vulcanized to the shoe bottom (9,10) that is made from a polyurethane material or a cork/latex composite material as it is done for producing the sandal according FIGS. 2 to 4.

To show better the stabilizing layer (7) which is covered at one side by the wide upper-material band (8) there is made in FIGS. 3 and 6 an omission at the right lower part of this band (8) thus showing the side of the layer (7). This is made additionally to the dotted lines marking the end of its outer upwardly projecting portion (12).

Above or below this line there is indicated also the line of the upper part of the edge region (16) of the insole (15).

List of reference numbers

| | |
|---|---|
| 1 | shoe bottom |
| 2 | sole rim of the shoe bottom (1) |
| 3 | strapping |
| 4 | insole |
| 5 | edge region of the insole (4) |
| 6 | lip of the sole rim (2) |
| 7 | stabilizing layer |
| 8 | strapping |
| 9, 10 | shoe bottom designed as a dished sole |
| 11 | raised sole rim of the shoe bottom (9, 10) |
| 12 | outer upwardly projecting portion of the stabilizing layer (7) |
| 13 | recess along the sole rim (11) |
| 14 | footbed |
| 15 | insole |
| 16 | edge region of the insole (15) projecting upward beyond the edge of the shoe bottom |
| 17 | end face of the raised sole rim (11) |
| 18 | end face on the tapering strapping (8) |
| 19 | recess for toes |
| 20 | toe spreader |
| 21 | transverse arch support with pad |
| 22 | heel recess |
| 23 | outer longitudinal arch support |

What is claimed is:

1. A sandal comprising:

a shoe bottom with raised sole rims on either side of the shoe bottom, an outwardly facing recess extending along an edge of at least one of the raised sole rims, and an upper surface, wherein the upper surface includes a contoured footbed adapted to coincide with the plantar surface of the foot;

an upper strapping material with an edge region positioned in the recess;

a cover sole connected to the upper surface of the shoe bottom, and having raised edge regions aligned with and extending past the raised sole rims on either side of the shoe bottom; wherein the raised edge regions each form a lateral fastening portion for attachment to the upper strapping material.

2. Sandal according to claim 1, wherein the upper strapping material is glued to the raised edge regions of the cover sole.

3. Sandal according to claim 1, wherein at least one of the raised sole rims has a lip that overlaps the strapping material.

4. Sandal according to claim 1, wherein the shoe bottom comprises a dished sole with a footbed that decreases in height toward the ball part of the foot and extends outwardly.

5. Sandal according to claim 1, wherein the cover sole is a thin leather sole with a thickness of from 0.07 cm to 0.1 cm.

6. Sandal according to claim 1, wherein the shoe bottom is made of a polyurethane material or a composite material containing a natural latex/cork mixture.

7. The sandal of claim 1, wherein the upper strapping material has an inside surface glued to the raised edge regions of the cover sole.

8. Sandal according to claim 1, wherein the recess is arranged laterally on the outside over the entire length of the at least one of the raised sole rims over which the edge region of the strapping material is positioned.

9. Sandal according to claim 8, wherein an edge surface of the strapping material abuts an edge surface of the raised sole rims to form a butt joint.

10. The sandal of claim 1, wherein the shoe bottom comprises a bottom sole portion and an interior sole portion between which a stabilizing layer is disposed, wherein the stabilizing layer extends to or past the raised edge regions of the cover sole and is fastened to an inside surface of the upper strapping material.

11. The sandal according to claim 10, wherein an end portion of the upper strapping material is tapered at an angel sufficient to maintain a sufficiently uniform thickness between an upper portion of the strapping material and the tapered end portion in combination with the cover sole and the stabilizing layer.

12. The sandal according to claim 10, wherein the stabilizing layer comprises a woven fabric.

13. The sandal according to claim 10, wherein the shoe bottom comprises a dished sole with a footbed that decreases in height toward the ball part of the foot and extends outwardly.

14. A shoe bottom comprising:

a bottom sole portion and an interior sole portion between which a stabilizing layer is disposed, wherein the interior sole portion includes a contoured footbed adapted to coincide with the plantar surface of the foot with an upwardly extending sole rim that surrounds the footbed; and a cover sole fastened as an insole connected to the shoe bottom, and having raised edge regions extending past the sole rims along the two lateral sides of the shoe bottom; wherein the raised edge regions each form a lateral fastening portion for attachment to upper strapping material, and the stabilizing layer extends to or past the raised edge regions of the cover sole and is fastened to an inside surface of the upper strapping material.

15. The shoe bottom of claim 14, wherein the stabilizing layer comprises a woven fabric.

16. The shoe bottom of claim 14, wherein the upwardly extending sole rim has a lip on either side of the shoe bottom that is fastened to an upper strapping material.

17. The shoe bottom of claim 14, wherein the cover sole is a thin leather sole with a thickness of from 0.07 cm to 0.1 cm.

18. The shoe bottom of claim 14, wherein the footbed decreases in height toward the ball part of the foot and extends outwardly.

19. The shoe bottom of claim 14, wherein the shoe bottom is made of a polyurethane material or a composite material containing a natural latex/cork mixture.

20. The shoe bottom of claim 14, further comprising an outwardly opening recess extending along lateral sides of the outwardly extending sole rims with an upper strapping material having an edge region positioned in the recess.

21. The shoe bottom of claim 14, wherein the contoured footbed comprises a recess for accommodating the toes; a toe spreader; a transverse arch support having a pad; a recess for the heel; and an outer longitudinal arch support.

22. A sandal comprising:

a shoe bottom with raised sole rims on either side of the shoe bottom, and an upper surface, wherein the upper surface includes a contoured footbed adapted to coincide with the plantar surface of the foot;

an upper strapping material; and a cover sole fastened to the upper surface of the shoe bottom, wherein the top surface of the cover sole parallels the upper surface of the contoured footbed, the cover sole having raised edge regions aligned with and extending past the raised sole rims on either side of the shoe bottom, wherein the raised edge regions each form a lateral fastening portion for attachment to the upper strapping material.

23. The sandal of claim 22, wherein the upper strapping material has an inside surface glued to the raised edge regions of the cover sole.

24. The sandal of claim 22, wherein the shoe bottom comprises a bottom sole portion and an interior sole portion between which a stabilizing layer is disposed, wherein the stabilizing layer extends to or past the raised edge regions of the cover sole and is fastened to an inside surface of the upper strapping material.

25. The sandal according to claim 22, wherein the shoe bottom includes an outwardly opening recess extending along at least one of the raised sole rims of the shoe bottom and an edge region of the upper strapping material is positioned in the recess.

* * * * *